US006131512A

United States Patent [19]

Verlinden et al.

[11] Patent Number: 6,131,512

[45] Date of Patent: Oct. 17, 2000

[54] PRINTING MASTER COMPRISING STRAIN GAUGES

[75] Inventors: Bart Verlinden, Tongeren; Johan Van Hunsel, Alken, both of Belgium

[73] Assignee: Agfa-Gevaert, N.V., Mortsel, Belgium

[21] Appl. No.: 09/241,294

[22] Filed: Feb. 1, 1999

Related U.S. Application Data

[60] Provisional application No. 60/079,869, Mar. 30, 1998.

[30] Foreign Application Priority Data

Feb. 3, 1998 [EP] European Pat. Off. ..... 98200318

[51] Int. Cl.[7] ..... B41N 1/00; B41F 27/00

[52] U.S. Cl. ..... 101/368; 101/415.1; 101/486

[58] Field of Search ..... 101/368, 378, 101/382.1, 389.1, 415.1, 485, 486, DIG. 36; 33/617–621

[56] References Cited

U.S. PATENT DOCUMENTS

| | | | |
|---|---|---|---|
| 3,858,512 | 1/1975 | Simeth | 101/415.1 |
| 3,876,301 | 4/1975 | Kosugi et al. | 101/DIG. 36 |
| 4,603,641 | 8/1986 | Jeschke et al. | 101/415.1 |
| 5,052,120 | 10/1991 | Lubberts | 101/415.1 |
| 5,097,763 | 3/1992 | Simeth | 101/415.1 |

FOREIGN PATENT DOCUMENTS

| | | |
|---|---|---|
| 0 460 249 A1 | 12/1991 | European Pat. Off. . |
| 29 18 432 | 11/1980 | Germany . |

*Primary Examiner*—Stephen R. Funk
*Attorney, Agent, or Firm*—Breiner & Breiner

[57] ABSTRACT

A printing master 12 is described which includes a printing element and a base 33, characterized in that base 33 is provided with one or more strain gauges 31 and electric connections for measuring electric resistance. In a preferred embodiment, the printing element is a plate having a printing surface 35, of which the back side 37 is laminated to base 33. The printing master 12 may have an optional adhesive layer 36 and/or protective layer 32. The registration of the printing master can be adjusted conveniently and accurately by measuring the resistance of the strain gauges.

14 Claims, 1 Drawing Sheet

PRINTING MASTER COMPRISING STRAIN GAUGES

The application claims the benefit of U.S. Provisional Application Ser. No. 60/079,869 filed Mar. 30, 1998.

FIELD OF THE INVENTION

The present invention relates to the use of strain gauges for adjusting the registration of printing masters in a printing press.

BACKGROUND OF THE INVENTION

Most color printing techniques use a so-called printing master such as a printing plate which carries an image and is mounted on the plate cylinder of a printing press. The printing master has a printing surface of which some areas are capable of accepting ink (the printing areas). In lithographic printing, the printing surface is a so-called lithographic surface consisting of oleophilic, ink accepting areas and oleophobic, ink repellent (non-printing) areas.

These printing techniques are binary processes wherein ink is transferred from the printing surface of the printing master to a (paper) substrate. Continuous tones are simulated by a so-called halftone image generated by a screening process. In conventional screening techniques the halftone image consists of dots which are equally spaced and vary in size. Frequency-modulated (also called stochastic) screening techniques use a different approach wherein small, equally-sized halftone dots are randomly placed and the observed density is determined by the number of these dots per square unit.

Multi-color prints are obtained by consecutively printing a limited set of process colors onto the substrate and each process color requires a separate printing master carrying the halftone image that is obtained by color separation and screening. The number of process colors may vary from two (e.g. black and one additional custom color such as the so-called spot-color printing process), to four (the widely used cyan, magenta, yellow and black subtractive primary colors) or even more (e.g. the so-called Hifi-color process). In order to obtain high quality prints these halftone color images need to be perfectly aligned. Misalignment, also called misregistration, may lead to printing artifacts such as moiré (repetitive patterns often visible on a macroscopic scale). Though line or text printing requires no screening, bad registration of the printing masters can cause noticeable white gaps where colors should meet.

Nowadays printing masters are generally obtained by the so-called computer-to-film method (CtF) wherein various pre-press steps such as typeface selection, scanning, color separation and layout are accomplished digitally and the electronic files are transferred onto graphic arts film using an image-setter (one film for each process color). The processed film then can be used as a mask for the exposure of a plate precursor and after optional plate processing, a printing plate is obtained. The computer-to-plate method (CtP), also called direct-to-plate method, bypasses the creation of film and the digital document is transferred directly onto a plate precursor. In a special type of a computer-to-plate process, sometimes called 'computer-to-plate-on-press' (CtPoP), the plate precursor is exposed after being mounted on the plate cylinder. CtPoP reduces the chance of misregistration significantly because no intermediate films are used and the plates are firmly mounted by clamps on the plate cylinder at the moment of exposure.

Even in the CtPoP method, several on-press phenomena may cause the plates to print out of register. Each plate cylinder is characterized by its specific mechanical properties and tolerances (pressure of contacting rollers, register pins clearance, driving mechanism etc.). In addition, the printing plate itself is not dimensionally stable during processing and printing, especially if the plate comprises a flexible, e.g. polyester or paper support. The plate is slightly stretched by tightening the clamping bolts of the plate cylinder and may relax afterwards. Still other parameters such as temperature changes and moistening by the ink and fountain solution (in lithographic printing) may cause dimensional changes of each printing plate. Therefore, quite some research has been carried out in order to find solutions that minimize the dimensional changes of printing plates.

EP-A-644,064 discloses a lithographic printing plate having on one side of a flexible support a layer comprising micro-particles of pressure sensitive adhesive covered with a protective stripping layer that is removed before mounting the plate on the plate cylinder. EP-A-690,349 discloses a method for making lithographic substrates having as support a laminate of aluminum and plastic. EP-A-807,534 also discloses a method to reduce the dimensional instability of the printing plate having a flexible support by laminating its back side (i.e. the side opposite to the printing surface carrying the image) to a base which is more dimensionally stable, e.g. a metallic base or a base made of a composite material comprising fibers and a resin matrix. Though these methods indeed may reduce the dimensional shifts of each individual plate, it gives no solution for adjusting the registration of the plates by controlling the dimensional correlation between multiple plates in a multi-color printing job.

In U.S. Pat. No. 5,531,162 a method is described for bringing plates in register that relies on a measuring device which uses the edges of the plate at the clamps of the plate cylinder as a reference. This method only provides a solution for controlling the plate deformation in one dimension perpendicular to the axis of the plate cylinder. The stretching of the plate upon tightening the clamping bolts causes a constriction of the plate along a line parallel to the axis of the plate cylinder, said constriction being maximal in the middle between both clamped plate edges. As a conclusion, there is a need for an improved method for printing plate registration.

SUMMARY OF THE INVENTION

It is an object of the present invention to provide a solution for conveniently characterizing and accurately adjusting the registration of printing masters, preferably in both dimensions perpendicular and parallel to the axis of the plate cylinder so that the dimensional correlation of individual printing plates in a multi-color printing job can be optimized. This object is realized by a printing master as defined in claim 1, of which preferred embodiments are disclosed in the dependent claims.

It is also an object of the present invention to provide a method for making a printing master according to the present invention. This object is realized by the methods of the attached claims.

Further advantages and embodiments of the present invention will become apparent from the following description and drawings.

DETAILED DESCRIPTION OF THE INVENTION

Figure 1:
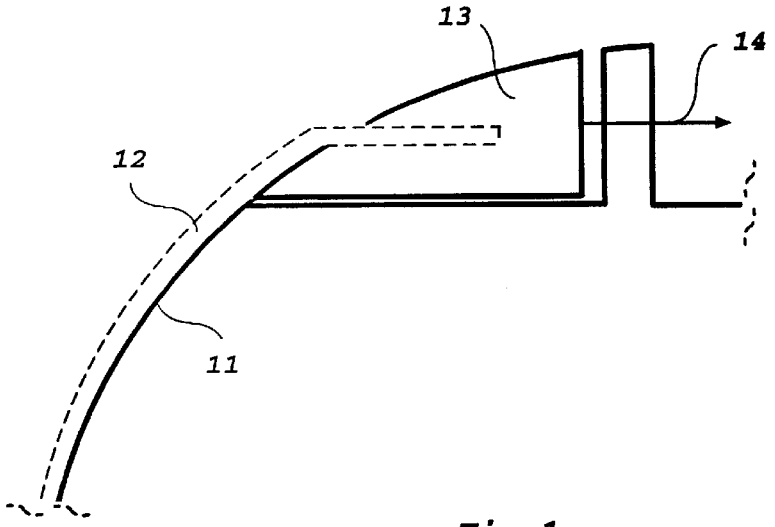
FIG. 1 shows schematically a cross-section of a plate cylinder and a printing master mounted thereon.

The printing master of the present invention comprises an element having a printing surface and a base provided with strain gauges and means for electrically connecting the strain gauges to a device for measuring electric resistance. The term "printing element" will be used herein as an alternative for "element having a printing surface". Said means for electrically connecting the strain gauges to a device for measuring electric resistance will be referred to herein as "connecting means" and the base provided with strain gauges and connecting means as "the base of the present invention".

In one embodiment, the printing element may consist of a composition coated on the base of the present invention, said composition being capable of having a printing surface after image-wise exposure and optional processing. In another embodiment, the printing element may be a printing plate which comprises a support and a printing surface after image-wise exposure and optional processing, the opposite surface of said plate (also called back side) being in close contact with the base of the present invention. According to still another embodiment of the present invention, the strain gauges and connecting means may be directly attached to the back side of a printing plate. In the latter embodiment, the support of the printing plate and the base of the present invention are identical elements. A drawback of the latter embodiment is the time consuming and cumbersome procedure to be carried out for providing the back side of a printing plate with strain gauges and connecting means and said procedure must be repeated for each printing plate in each printing job.

Before discussing the elements of the present invention in detail, the advantageous effect of the present invention will be explained. Because the printing element and the base of the present invention are in close contact, the printing element and the base are stretched congruently upon mounting the printing master on a plate cylinder of a printing press. The prior art solutions attempt to improve the registration of the printing plates in a multi-color printing press by minimizing their deformation and dimensional shifts. As explained in the introduction, these prior art solutions are insufficient because each plate may behave differently on the press according to its particular environment. The present invention, which relies on the above mentioned principle of congruent deformation, provides an alternative and improved solution that is based on controlling and characterizing said deformation by using strain gauges, rather than trying to minimize the deformation and dimensional shifts of the printing master. In this way, the registration may be optimized, before as well as during printing, by adjusting the plates individually according to the signals measured by the strain gauges and a good dimensional correlation between the plates is guaranteed and maintained.

The present invention will now be illustrated by reference to FIGS. 1 and 2. The process of mounting a printing master 12 on the surface of a plate cylinder 11 typically involves the following steps :

(i) aligning the leading edge of the printing master 12 with the register pins of the leading pin bar of the plate cylinder;

(ii) attaching the leading edge of the printing master 12 to the leading plate clamps of the plate cylinder;

(iii) rotating the plate cylinder while being in contact with a counter-pressure roller (which may be the blanket cylinder in offset presses) so that the printing master 12 is bent around the plate cylinder;

(iv) aligning the trailing edge of the printing master 12 with the trailing register pin bar and attaching said trailing edge to the trailing plate clamps;

(v) screwing down the trailing clamping bolts until the entire surface of the printing master 12 is in contact with the surface 11 of the plate cylinder;

(vi) firmly tightening the trailing plate clamps 13, thereby exercising a force 14 on both edges of the printing master 12 which causes the plate to stretch along the direction indicated by arrows 14, perpendicular to the axis of the plate cylinder.

FIG. 1 shows one particular type of plate clamp 13; many other configurations are known and supplied by various press manufacturers and the above method of mounting a plate onto the cylinder may vary accordingly. Most presses are provided with means for adjusting the registration of the plates in both the lateral and the axial orientation.

Figure 2:
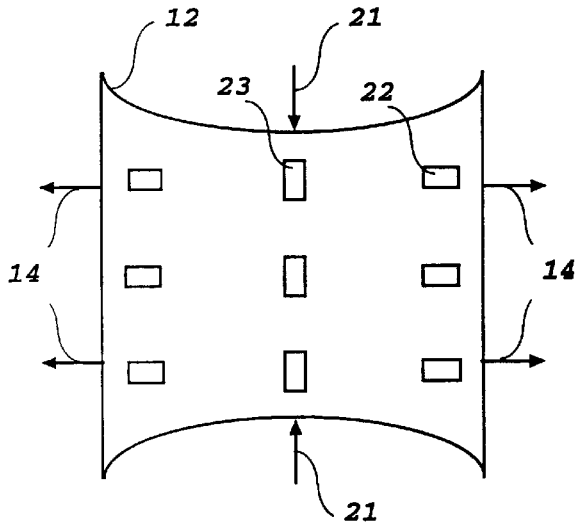
FIG. 2 shows schematically a 2-dimensional projection of an embodiment of a printing master according to the present invention, said printing master being mounted on a plate cylinder and provided with a number of strain gauges.

During the last step of the above method the printing master 12 may shrink along the direction indicated in FIG. 2 by arrows 21 parallel to the axis of the plate cylinder. Said shrinking deforms the printing master 12 to a constricted shape, which is exaggerated in FIG. 2. In the embodiment of FIG. 2, the printing master 12 is provided with nine strain gauges 22 and 23 to measure local strain at nine different areas of the printing master 12. The six strain gauges 22 that are oriented perpendicularly to the axis of the plate cylinder measure the stretching of the printing master 12 along the direction 14 and the three strain gauges 23 measure the shrinking of the printing master 12 along the direction 21 parallel to the axis of the plate cylinder. In another embodiment, strain gauges may be used that each provide individual strain signals in both perpendicular directions simultaneously.

It is evident that the nine strain gauges indicated in FIG. 2 are an example of a possible embodiment of the present invention. Any number of strain gauges may be chosen as well as their location and orientation on the surface of the printing master according to the accuracy required and the dimensions of the printing plate.

Figure 3:
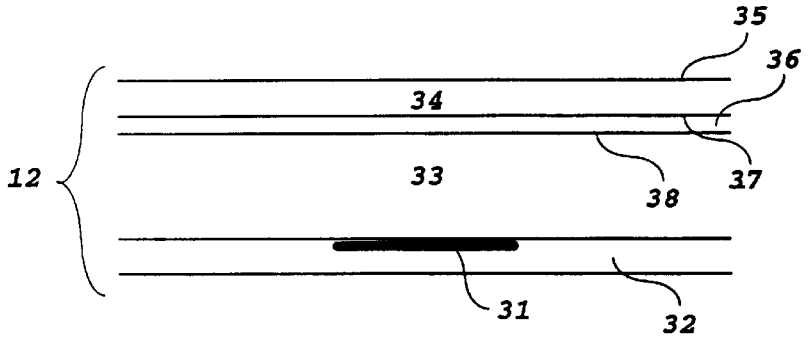
FIG. 3 shows schematically a magnified view of the layers comprised in a preferred embodiment of a printing master according to the present invention.

A highly preferred embodiment of a printing master according to the present invention is indicated in FIG. 3 (the thickness of the layers is not drawn to scale). The printing master 12 consists of a printing plate 34 of which the back side 37, opposite to the printing surface 35, is laminated to the base 33. Said base 33 may be reused after the printing job by separating the printing plate from the base and laminating said base to the back side of another printing plate. As explained below, said lamination is preferably carried out by using an optional adhesive layer 36. The strain gauges 31 and connecting means (not indicated in FIG. 3) are preferably embedded in an additional protecting layer 32 which may be coated, glued or laminated on the base 33 to shield the strain gauges and connecting means from mechanical damage, moisture, ink, solvents etc. In another embodiment of the present invention, the strain gauges and connecting means may be attached at the plate side 38 of the base, i.e. comprised in the adhesive layer 36, thereby eliminating the use of a protective layer 32.

The elements of the present invention are now discussed in more detail.

The strain gauges

Strain may be defined as the one-dimensional change of a body which is deformed by external forces. Strain gauges are known in the art of electromechanics as very accurate and convenient tools for measuring small deformations of surfaces and are commercially available from a number of manufacturers.

Typical strain gauges are thin rectangular elements which can be glued onto the surface of the body of which the stretching or shrinking is to be quantified and are characterized by a change in electric resistance upon deformation as defined by the following parameters:

$R_o$: the electric resistance in relaxed state,

R: the electric resistance in deformed state, $l_o$: length in relaxed state, l: length in deformed state, $\epsilon = l - l_o$: the absolute dimensional change of the strain gauge, and k, a sensitivity factor defined by the ratio of the relative change of the electric resistance and $\epsilon$: $k = (R - R_o)/R_o/\epsilon$.

Since $R_o$ and k are specified by the manufacturer of the strain gauge, the absolute dimensional change $\epsilon$ upon stretching or shrinking can be obtained according to the above formula by measuring R. The quantity $\epsilon/l$ is called herein local strain, which is a measure of the relative dimensional change of the surface at the area where the strain gauge is attached. The combination of a highly sensitive electric resistance measuring device with a strain gauge having high values of $R_o$ and k allows to measure local strain values within an accuracy of 1 $\mu$m/m.

The strain gauges used in the present invention are preferably selected according to the composition of the base whereon said strain gauges are to be attached. Suitable strain gauges for steel, aluminum, rubber, plastics and other materials are commercially available. The strain gauges are preferably glued to the base following the procedure specified by the manufacturer of the strain gauge.

The connecting means and electric resistance measuring device

Various methods are known to the skilled person for providing the connecting means on the surface of the base of the present invention. Examples of such methods are vacuum deposition and etching techniques used in the manufacturing of printed circuit boards. Alternatively, the base may be provided with connecting means by printing techniques or so-called thick film methods as described in Meas. Sci. Technol., 8(1), p.58–70 (1997); Sens. Mater. 8(7), p.431–438 (1996) and Plast. Rubber Process., 8(2), p.105–114 (1987). The latter techniques may also be used to provide the strain gauges on the base.

According to the present invention, the connecting means are coupled to a device for measuring electric resistance and these resistance values can be used for adjusting the registration of the printing master. The connecting means may connect the strain gauges to the electric resistance measuring device permanently so that the registration of the printing plates can be monitored throughout the printing job, e.g. by the application of sliding contacts on the plate cylinder. The electric resistance measuring device may also be comprised inside the plate cylinder and its output may be transmitted using remote sensing techniques. The resistance values measured at each strain gauge may be fed into a computer program which calculates the local strain distribution over the whole printing plate by interpolation. In a fully automatic embodiment of the present invention, said computer program may control the stretching force exercised by the clamps on each printing plate in a multi-color printing job in order to correct misregistration without human intervention. The electric resistance measuring device is preferably very sensitive, i.e. capable of measuring small resistance differences $R - R_o$, e.g. a device comprising a Wheatstone bridge. Since the electric resistance of strain gauges is also dependent on temperature, said electric measuring device is preferably provided with a temperature compensation. Suitable devices are commercially available from strain gauge suppliers.

The optional protective layer

The strain gauges and connecting means are preferably embedded in a protective layer which may be coated, glued or laminated onto the base to shield the strain gauges and connecting means from mechanical damage, moisture, ink, solvents etc. In the embodiment wherein the base is a composite material comprising fibers and a resin matrix, the optional protective layer is preferably made of the same composite material as the base. Polyurethane lacquer, polytetrafluoroethylene and silicones may be used to form said protecting layer and still other compositions are commercially available from strain gauge manufacturers and other suppliers.

The protective layer may cover the entire surface of the base provided with strain gauges and connecting means. Alternatively, the protective layer may be provided only at the areas whereon the strain gauges and/or connecting means are attached.

A highly preferred protective layer is characterized by a low friction coefficient with respect to the surface of the plate cylinder so as to prevent stick-slip phenomena of the base during stretching. As an alternative solution for preventing sticking, the plate cylinder may be coated with a lubricating layer.

The base and optional adhesive layer

The base is preferably made of a material which is more dimensionally stable than polyester or paper, e.g. a metal base such as foils of aluminum or stainless steel. Highly preferred bases are made of a composite material comprising fibers and a resin matrix. The fibers are preferably selected from carbon fibers, boron fibers, silicon carbide fibers, and mixtures thereof, although other fibers such as glass fibers, aramid fibers, polyamide fibers and natural fibrous materials such as jute may also be used. Preferably the fibers have an average diameter of from 3 $\mu$m to 20 $\mu$m. The flexural E-modulus of the fibers is preferably greater than 200 GPa. The majority of the fibers suitably have lengths which extend from one 15 end of the base to the other in the direction of the load, although mixtures of long and short fibers can be used. In fact, the maximum length of the fibers can be somewhat greater than the length of the base where the fibers are applied diagonally. The fibers may constitute from 30% to 70% by volume of the composite material, although a higher packing fraction is possible with fibers of mixed diameter.

The resin is preferably selected from thermo-setting and thermoplastic polymers, and mixtures thereof, such as epoxy resins, furane resins, silicone resins, polyester resins, phenolic resins, vinylester resins, polyamide (PA) resins, polypropylene (PP) resins, polyethylene resins (PE), polyethylene terephthalate resins (PETP), polybutylene terephthalate resins (PBT), and polyphenyloxide resins (PPO).

The thickness of the base is preferably comprised between 20 $\mu$m and 400 $\mu$m, more preferably between 25 $\mu$m and 300 $\mu$m, most preferably between 50 $\mu$m and 250 $\mu$m. The base is suitable for being mounted on the plate cylinder of a printing press. Preferably said base also comprises register "punches". If required by the printing press used, said base also comprises holes for a press pin bar or a bend for mounting the printing plate on a printing press.

The base may be laminated to the back side of the printing plate by means of an adhesive such as a glue, but the use of an adhesive layer is preferred. The adhesive layer may be applied to the base or to the back side of the printing plate. Said adhesive layer can be a pressure-adhesive layer but is preferably a thermo-adhesive layer. The lamination is preferably reversible, meaning that the base of the present invention and the printing plate can be peeled apart.

Suitable thermo-adhesive layers (TALs) for use in the present invention have a glass transition temperature Tg between 10° C. and 70° C. as measured with the 1090 THERMOANALYZER of Du Pont Co. During a lamination step a minimal thermal load should be imposed to the material in order to save energy and diminish the risk for material change or deformation. For these reasons the Tg of the TAL is preferably below 80° C. The Tg value of the TAL can be determined by the Tg value of the polymer(s) used and/or by the addition of polymeric or low-molecular plasticizers or thermosolvents to the thermo-adhesive layer.

In order to induce easy film formation without unwanted sticking of the TAL to the printing surface of the printing element or to other materials, a TAL is preferably used with a Tg value between 20° C. and 65° C.

For ecological and practical reasons the TAL is preferably coated from an aqueous medium. Therefore the polymers are preferably incorporated as lattices. Preferred lattices are lattices of styrene, styrene-butadiene, styrene-(meth) acrylate and n.butylacrylate-methylmethacrylate-acrylonitrile. These lattices can contain other co-monomers which improve the stability of the latex, such as acrylic acid, methacrylic acid and acrylamide. Other possible lattices include polyvinylacetate, polyethylene-vinylacetate, polyacrylonitrile-butadiene-acrylic acid, polymethylmethacrylate-butylmethacrylate, polymethylmethacrylate-ethylacrylate, polystyrene-butylacrylate, polymethylmethacrylate-butadiene, polyester of terephthalic acid-sulphoisophthalic acid-ethyleneglycol, copolyester of terephthalic acid-sulphoisophthalic acid-hexanediol-ethyleneglycol.

Various additives can be present in the TAL to improve the layer formation or the layer properties, e.g. thickening agents, surfactants, leveling agents, thermal solvents and pigments.

Suitable pressure-adhesive layers (PALs) for use in the present invention comprise one or more pressure sensitive adhesives. Said pressure sensitive adhesives are preferably tacky elastomers e.g. block copolymers of styrene/isoprene, styrene/butadiene rubbers, butyl rubbers, polymers of isobutylene and silicones. Particularly preferred are natural rubbers and acrylate copolymers as disclosed in U.S. Pat. No. 3,857,731. Said acrylate polymers preferably consist of 90 to 99.5% by weight of at least one alkyl acrylate ester and 10 to 0.5% by weight of a monomer selected from the group consisting of substantially oil-insoluble, water-soluble, ionic monomers and maleic anhydride.

The acrylate ester portion preferably consists of those monomers that are hydrophobic, water emulsifiable, substantially water insoluble and which as homopolymers generally have a glass transition temperature of 20° C. or less. Examples of such monomers are iso-octyl acrylate, 4-methyl-2-pentyl acrylate, 2-methylbutyl acrylate and sec-butyl acrylate.

Examples of ionic monomers are e.g. trimethylamine methacrylamide, trimethylamine p-vinylbenzimide, ammonium acrylate, sodium acrylate, N,N-dimethyl-N-1-(2-hydroxypropyl)amine methacrylamide and maleic anhydride. The used pressure sensitive adhesive preferably has a continuous-coat (100% coverage) peel adhesion value, when applied to untreated paper, between 0.1 and 10 N/cm width.

The pressure-adhesive layer comprising a pressure sensitive adhesive may contain a binder. Suitable binders for use in combination with the pressure sensitive adhesives are binders that are inert towards the pressure sensitive adhesives i.e. they do not chemically attack the pressure sensitive adhesives or act as a solvent for them. Examples of such binders are nitrocellulose, urethanes, gelatin, polyvinyl alcohol, etc.

The amount of binder should be chosen such that the pressure sensitive adhesives laminate effectively. Preferably the amount of binder is lower than 2.5 parts by weight with respect to the pressure sensitive adhesives and more preferably lower than 0.6.

When the printing plate comprises a flexible support and the used adhesive is a thermo-sensitive layer either applied on the base of the present invention or on the back side of the printing plate, said laminating is effected by means of a heating step, preferably at a temperature of less than 100° C., more preferably at a temperature between 35° C. and 90° C. in order to retain the dimensional stability of the exposed and optionally developed imaging element. Said heating may be applied to either or both the printing plate and the base of the present invention before, while or after bringing the base in contact with the back side of said printing plate.

Said laminating can be effected manually but preferably is effected in a laminating means called a laminator. A laminator preferably comprises a pair of two heatable rollers, having an adjustable pressure to each other and moving at a fixed or an adjustable speed. The lamination with a laminator is effected by bringing the two elements which have to be laminated in close contact with each other and said sandwich is then put through between the two rollers of the laminator. The lamination parameters (roller temperature, roller impression and put-through speed) can be established dependent on the properties of the base of the present invention, of the printing plate and particularly of the TAL so that a good adhesion between the base and the printing plate is obtained. When the adhesive layer is a pressure-adhesive layer, said lamination requires a pressure step. Said pressure is applied while the base is in contact with the back side of the printing plate.

The adhesive layer whether applied to the base of the present invention or to the back side of a printing plate, may be shielded by a stripping layer, which is removed just before lamination.

The printing master

A printing master according to the present invention may be obtained by providing the base of the present invention with an element having a printing surface. In the so-called wipe-on method, the base is coated with a photosensitive composition comprising oligomeric diazonium salts and after image-wise exposure and processing, a printing plate is obtained. Other suitable coating solutions may contain diazo resins or a photopolymerizable composition. Another method may involve the coating of so-called switchable polymers or other compounds of which the ink accepting properties may be image-wise modified onto said base, as described in DE 19,612,927. Another method for making a printing master according to the present invention may rely on electro-deposition of copper ions from a solution as described in U.S. Pat. No. 5,206,102 onto an oxide semiconductor such as NiO which may be coated on the base of the present invention. Said coating or electro-deposition may optionally be carried out at the side of the base which holds the strain gauges and connecting means or at the opposite side.

A printing plate may also be used as element having a printing surface in the printing master according to the present invention. Preferably said printing plate is a lithographic printing plate, though other types such as letterpress or flexographic plates are also suitable.

Two basic types of lithographic printing plates are known. According to a first type, so called wet printing plates, both water or an aqueous dampening liquid and ink are applied to the plate surface that contains hydrophilic and hydrophobic areas. The hydrophilic areas will be soaked with water or the dampening liquid and are thereby rendered oleophobic while the hydrophobic areas will accept the ink. A second type of lithographic printing plates operate without the use of a dampening liquid and are called driographic printing plates. This type of printing plates comprise highly ink repellent areas and oleophilic areas. Generally the highly ink repellent areas are formed by a silicon layer.

Lithographic printing plates can be prepared using a photosensitive lithographic printing plate precursor, also called imaging element. Such imaging element is exposed in accordance with the image data and is generally developed thereafter so that a differentiation results in ink accepting properties between the exposed and unexposed areas. Examples of photosensitive lithographic printing plate precursors are for example the silver salt diffusion transfer (hereinafter DTR) materials disclosed in EP-A-410500, EP-A-483415 and EP-A-423399, imaging elements having a photosensitive layer containing diazonium salts or a diazo resin as described in e.g. EP-A-450199, imaging elements having a photosensitive layer containing a photopolymerizable composition as described in e.g. EP-A-502562, EP-A-491457, EP-A-503602, EP-A-471483 or DE-A-4102173.

Alternatively a lithographic printing plate may be prepared from a heat mode recording material as a lithographic printing plate precursor. Upon application of a heat pattern in accordance with image data and optional development the surface of such heat mode recording material may be differentiated in ink accepting and ink repellent areas. The heat pattern may be applied by a direct heating source such as a thermal head but also indirectly by a light source as e.g. an infrared laser. In the latter case the heat mode recording material will include a substance capable of converting the light into heat. Heat mode recording materials that can be used for making a lithographic printing plate precursor are described in e.g. EP-A-573091, DE-A-2512038, FR-A-1473751, Research Disclosure 19201 of April 1980 or Research Disclosure 33303 of January 1992.

As supports for the above mentioned lithographic printing plates there are known metal supports such as e.g. aluminum and flexible supports such as e.g. paper or polyester film supports. Generally the flexible supports are used for short run jobs where they have a cost advantage over metal supports. Furthermore, if a transparent flexible support is used, exposure of the lithographic printing plate precursor may proceed through the support which allows the use of cameras without special optics. The solution provided by the present invention is especially advantageous when plates having a flexible support are used as printing element, as such plates are more susceptible to dimensional changes and deformation than plates with metal supports.

The printing plate (precursors) are preferably scan-wise exposed using a laser, a light emitting diode or an array thereof. The light source used is depending on the spectral sensitivity of the imaging element. Argon lasers, helium-neon lasers, semiconductor lasers, e.g. NdYAG or laser diodes can be used. The imaging apparatus can be configured as a flatbed recorder or preferably as a drum recorder, with the imaging element mounted to the internal or external cylindrical surface of the drum. In the CtPoP workflow, said external drum may be the plate cylinder.

In a CtPoP workflow materials are preferred that require no (wet) processing after the scan-wise exposure. However most imaging materials require a development step in order to yield a lithographic printing plate. Depending on the imaging element said development step may proceed by rubbing the exposed imaging element with e.g. a cotton pad. In most cases said development step requires the treatment of said exposed imaging element with an aqueous solution, particularly an aqueous alkaline solution.

A preferred example of such printing plate precursors that require wet processing is a plate that works according to the DTR-process. A first type of such DTR plates comprise on a flexible support in the order given an optional base coat, a silver halide emulsion layer and an image-receiving surface layer. To obtain a lithographic plate from such a DTR precursor, the material is scan-wise exposed e.g. by means of a laser or a LED, and is subsequently developed in an alkaline processing liquid in the presence of a developing agent and a silver halide solvent. The plate surface may then be neutralized with a neutralizing agent. After processing the image-receiving layer will carry a silver image that is capable of accepting greasy ink in a printing process using a dampening liquid. As an alternative said DTR lithographic printing plate precursor comprises in the order given on the hydrophilic surface of an aluminum support an image-receiving layer and a silver halide emulsion layer. To obtain a lithographic plate from such a precursor the precursor is scan-wise exposed e.g. by means of a laser or a LED, and is subsequently developed in an alkaline processing liquid in the presence of a developing agent and a silver halide solvent. The printing plate precursor is then treated to remove the layer(s) on top of the image-receiving layer. After processing the image-receiving layer will carry a silver image that is, optionally after a treatment with a finisher, capable of accepting greasy ink in a printing process using a dampening liquid.

Methods according to the present invention

A method for making a printing master according to the present invention comprises the steps of mounting a base of the present invention on a plate cylinder of a printing press and providing said base with an element having a printing surface. These steps may be executed in any order. The base of the present invention may first be provided with said printing element and the printing master thus obtained is then mounted on the plate cylinder. Or said base may first be mounted on a plate cylinder and then be provided with an element having a printing surface as described above. Said printing element may be a ready-to-use printing plate which has been exposed and optionally processed before being laminated on the base. Alternatively, a printing plate precursor may be laminated on the base of the present invention mounted on the plate cylinder and said precursor can then be exposed and optionally processed on-press (CtPoP workflow). A highly preferred CtPoP method according to the present invention comprises the step of on-press coating a composition onto the base of the present invention, which is mounted on the plate cylinder, then exposing and optionally processing said coated composition to obtain a printing element.

The base of the present invention may also be mounted on the plate cylinder permanently. In that case the printing element is removed from the base after the printing job and the base is provided with another printing element before the start of the next printing job. Said removal may be carried out by peeling apart the printing plate from the base or, in case the printing element is not a plate but a coated composition, by dissolving, scraping away or other means for removing said coated composition from the base.

The printing master according to the present invention may be used in combination with other registration devices and methods, e.g. methods relying on reference measurements at the clamps of the plate cylinder such as the method described in U.S. Pat. No. 5,531,162. Other preferred registration methods may use displacement or force measurements at the clamps of the plate cylinder.

EXAMPLE

The example illustrating the present invention describes a printing master that comprises a metal base provided on one side with strain gauges and connecting means and being laminated at the other side to a DTR lithographic printing plate, which consists of (in the order given) a polyester support, a layer which enhances the adhesion of gelatin layers onto said polyester support, an anti-halation layer, a silver halide emulsion layer and a physical development layer (the latter becoming a lithographic printing surface after exposure and processing).

All percentages are by weight unless indicated otherwise.

Preparation of the silver halide emulsion coating solution.

A silver chlorobromide emulsion composed of 98.2 mol % of chloride and 1.8 mol % of bromide was prepared by the double jet precipitation method. The average silver halide grain size was 0.38 $\mu$m (diameter of a sphere with equivalent volume) and contained rhodium ions as internal dopant. The silver iodide content was established immediately after the physical ripening and before the chemical ripening by means of a co-precipitation of silver nitrate and a water soluble iodide. A homogeneously distributed and localized silver iodide phase was thus obtained. The emulsion contained 0.8 mol % of silver iodide per mole silver. The chemical ripening was performed directly after finishing th e silver iodide precipitation. After the chemical ripening 4-hydroxy-6-methyl-1,3,3a,7-tetraazaindene was added as a stabilizer in an amount of 290 mg per mole of Ag.

Prior to coating, the emulsion was spectrally sensitized using a red sensitizing dye in an amount of $4.9*10^{-4}$ mole per mole of Ag. Finally 2-mercapto-5-n.heptyl-1,3,4-oxadiazole (33.8 mg per mole of Ag) and 7-sulpho-nafto-(2,3-d)-oxazolidine-2-thione (540 mg per mole of Ag) were added to the emulsion.

Preparation of the DTR printing plate precursor

A polyethylene terephthalate film support having a thickness of 100 $\mu$m and being provided with an adhesion improving layer was coated with a lay er containing gelatin in an amount of 0.4 g/m$^2$ and colloidal silica having an average particle diameter of 7 nm in an amount of 0.4 g/m$^2$. The adhesion improving layer contained a copolymer of itaconic acid (2%), vinylidene chloride (88%) and methylmethacrylate (10%).

The emulsion coating solution was coated by means of the cascade coating technique to the above mentioned subbed polyethylene terephthalate support simultaneously with the anti-halation layer, the latter being coated from an aqueous solution consisting of 5.5% gelatin, 0.76% of carbon black, titanium dioxide particles and a non-water swellable latex. The emulsion layer was coated such that the silver halide coverage expressed as $AgNO_3$ was 1.25 g/m$^2$ and the gelatin content was 1.34 g/m$^2$. The emulsion layers further contained 0.350 g/m$^2$ of 1-phenyl-4,4'-dimethyl-3-pyrazolidone, 0.25 g/m$^2$ Of hydroquinone, 120 mg/m$^2$ of formaldehyde as a hardener and silica particles to improve the water-transport on press. The anti-halation layer was coated such that the amount of gelatin in the coated layer was 2.7 g/m$^2$.

This imaging element was dried and subjected to a temperature of 40° C. for 5 days and then the emulsion layer was overcoated with a layer containing PdS as physical development nuclei, hydroquinone at 0.4 g/m$^2$ and formaldehyde at 33 mg/m2. Finally, the printing plate precursor thus obtained was cut to a size of 510×400 mm.

Preparation of the printing plate

The above described printing plate precursor was image-wise exposed in an image-setter SelectSet 5000 (trade name of Agfa-Gevaert N.V., Belgium, and Bayer Corporation, U.S.A., for an internal drum image-setter comprising a He/Ne laser as light source) and processed with the activator described below for 20 seconds at 30° C., subsequently neutralized at 25° C. with the neutralization solution described below and then dried. The image to be printed contained a test pattern consisting of lines, text and halftone images.

The following processing solutions were used

| | |
|---|---|
| Activator: | |
| sodium hydroxide (g) | 30 |
| methylhydroquinone (g) | 2 |
| sodium sulphite anh. (g) | 35 |
| 1-methyl,4-butenyl,5-methyl-1,2,4-triazolium-3-thiolate (mg) | 800 |
| 2-Aminoethyl-aminoethanol (ml) | 45 |
| 2-mercapto-5-n.heptyl-oxa-3,4-diazole (mg) | 350 |
| ethylenediamine-tetraacetic acid sodium salt (g) | 1 |
| water to make | 1 liter |
| Neutralization solution: | |
| citric acid | 10 g |
| sodium citrate | 35 g |
| sodium sulphite anh. | 5 g |
| phenol | 50 mg |
| water to make | 1 liter |

Preparation of the metal base provided with strain gauges and connecting means.

A steel plate having a thickness of 100 pm and dimensions of 510×400 mm was cleaned thoroughly with Chlorothene NU (trade name of Hottinger Baldwin Messtechnik, hereinafter referred to as "HBM"). Nine strain gauges type XK51A3/350, supplied by HBM, were cleaned with Freon-TF, also trade name of HBM. These strain gauges are equipped with soldering pads and provide strain signals in two perpendicular directions. The nine strain gauges were glued onto the cleaned steel plate at the positions indicated in FIG. 2 according to the gluing instructions from HBM. More details and technical specifications of the strain gauges can be found in the Datenbuch from HBM, publication No. G24.01.6 "Dehnungsmeβstreifen mit Zubehör". The steel plate provided with nine strain gauges was then baked in an oven at 150° C. during one hour to dry the glue and render it sufficiently mechanically strong. Then a thin flexible PCB, equipped with the necessary tracks and soldering pads, was glued onto the surface of the steel plate provided with strain gauges. The PCB had a hole at the position of each strain gauge and soldering pads at the circumference of said hole, which were soldered to the pads of the strain gauge. Finally, the holes in the PCB were filled with a polyurethane lacquer type PU120, supplied by HBM, to form a protective layer that shields the strain gauge and soldering pads from mechanical impact, solvents, ink and moisture.

Preparation of the printing master

The back side of the printing plate described above was laminated to the thermoadhesive layer of Pressmatch Dry (a trade name of Agfa-Gevaert N.V., Belgium, for a laminate containing a PET-layer having a thickness of 50 μm and a thermo-adhesive layer containing a copolymer of vinylacetate-crotonic acid with a thickness of 5 μm). The PET-layer was then peeled away leaving on the side of the support opposite to the printing surface a thermo-adhesive layer with a thickness of 5 μm. This procedure was repeated another four times yielding at the end a thermo-adhesive layer with a thickness of 25 μm.

The printing plate was then laminated to the above metal base by contacting the thermo-sensitive layer of the plate to the surface of said metal base opposite to the surface provided with strain gauges and connecting means and then passing that sandwich through a laminator Pressmatch Dry APL 700 (trade name of Agfa-Gevaert N.V., Belgium) whereby said sandwich was brought at a temperature of 80° C.

The steel base comprised register punches and a bend required for mounting the printing master on the printing press.

The above procedure was repeated until four printing masters were obtained, each carrying one color selection for a printing job using standard CMYK colors.

Printing test results

After mounting the four printing masters on a four-color Heidelberg GT052-V printing press, the clamping bolts of the plate cylinders were adjusted until no electric resistance difference could be measured anymore between each of the strain gauges of a reference plate and the corresponding strain gauges of the three other plates ('corresponding' means located at matching areas of the plates). In this example the K plate was selected as the reference plate. A four-color printing job was started using commercial CMYK inks and fountain solutions. The first copies were printed in perfect register. After printing 10,000 copies, a degradation of the registration of the plates could be noticed. The press was stopped and the above procedure of minimizing the electric resistance differences between the strain gauges of the reference plate and the corresponding strain gauges of the other plates was repeated. Then the printing job was resumed and the printed copies showed a highly improved registration compared to the last copies before readjustment of the plates.

What is claimed is:

1. A printing master comprising an element with a printing surface and a base, characterized in that said base is provided with one or more strain gauges and with means for electrically connecting said strain gauges to a device for measuring electric resistance.

2. A printing master according to claim 1 wherein the base is a metallic base.

3. A printing master according to claim 1 wherein the base is made of a composite material comprising fibres and a resin matrix.

4. A printing master according to any of the previous claims wherein the strain gauges and the means for electrically connecting said strain gauges to a device for measuring electric resistance are embedded in a protective layer.

5. A printing master according to claim 4 wherein the protective layer consists of the same material as the base.

6. A printing master according to claim 1 wherein the element is a printing plate of which a side opposite to the printing surface is in close contact with the base.

7. A printing master according to claim 6 wherein an adhesive layer is present between the side opposite to the printing surface of the printing plate and the base.

8. A printing master according to claim 7 wherein the strain gauges and the means for electrically connecting said strain gauges to a device for measuring electric resistance are embedded in the adhesive layer.

9. A printing master according to claim 7 or 8 wherein the printing plate comprises a flexible support.

10. A method for making a printing master provided with strain gauges, comprising in any order steps comprising mounting a base on a cylinder of a printing press, said base being provided with one or more strain gauges and with means for electrically connecting said strain gauges to a device for measuring electric resistance; and providing said base with a printing element, wherein the providing of the base with a printing element is carried out by coating the base with a layer, said layer having a printing surface after image-wise exposure and optional processing.

11. A method according to claim 10 wherein the printing element is a printing plate comprising a flexible support.

12. A method according to claim 10, wherein the printing element is image-wise exposed on-press.

13. A method according to claim 12 wherein the printing element exposed on-press requires no processing step and is ready for use immediately after exposure.

14. A printing method comprising (i) making a printing master according to a method as defined in any one of claims 10, 11, 12, or 13 while the base is mounted on said cylinder;

(ii) bringing said printing master in contact with a printing ink and optionally with a dampening liquid;

(iii) printing;

(iv) separating the printing element from the base;

(v) repeating steps (i) to (iv).

* * * * *

UNITED STATES PATENT AND TRADEMARK OFFICE

CERTIFICATE OF CORRECTION

PATENT NO. : 6,131,512

DATED : October 17, 2000

INVENTOR(S) : Bart Verlinden et al

It is certified that error appears in the above-indentified patent and that said Letters Patent is hereby corrected as shown below:

Column 6, line 47, delete "15".

Column 11, line 40, "th e" should read -- the --.

Column 11, line 53, "lay er" should read -- layer --.

Column 12, line 2, "g/m$^2$ Of" should read -- g/m$^2$ of --.

Column 12, line 46, "pm" should read -- $\mu$m --.

Column 14, line 4, claim 3, "fibres" should read -- fibers --.

Column 14, bridging lines 6 and 7, claim 4, delete "any of the previous claims" and insert -- claim 1 --.

Signed and Sealed this

First Day of May, 2001

*Attest:*

Nicholas P. Godici

NICHOLAS P. GODICI

*Attesting Officer*

*Acting Director of the United States Patent and Trademark Office*